US005911660A

United States Patent [19]

Watson

[11] Patent Number: 5,911,660

[45] Date of Patent: Jun. 15, 1999

[54] STORM WINDOW PANEL

[76] Inventor: Arnold Q. Watson, 111 Edie Ann Dr., Apt. 215, Lafayette, La. 70508

[21] Appl. No.: 08/835,492

[22] Filed: Apr. 8, 1997

[51] Int. Cl.[6] ..... E06B 3/30; A47G 5/00

[52] U.S. Cl. ..... 52/202; 49/57; 49/464; 52/586.1; 52/586.2; 52/590.1

[58] Field of Search ..... 52/202, 203, 309.1, 52/506.05, 588.1, 586.1, 586.2, 589.1, 590.1, 591.4; 49/63, 464, 57, 61; 108/1.11, 56.1; 312/265.5

[56] References Cited

U.S. PATENT DOCUMENTS

| | | | |
|---|---|---|---|
| 2,924,858 | 2/1960 | Couse et al. | 52/586.2 X |
| 3,307,504 | 3/1967 | Cloyd et al. | 108/56.1 |
| 3,348,459 | 10/1967 | Harvey | 52/586.2 X |
| 4,163,592 | 8/1979 | Nelson | 312/265.5 X |
| 4,333,271 | 6/1982 | DePaolo . | |
| 4,497,858 | 2/1985 | Dupont et al. | 52/590.1 X |
| 4,685,261 | 8/1987 | Sequist . | |
| 4,931,340 | 6/1990 | Baba et al. | 108/51.11 X |
| 5,107,652 | 4/1992 | Sosa | 52/586.1 X |
| 5,383,315 | 1/1995 | Birs | 52/203 X |
| 5,457,921 | 10/1995 | Kostrzecha . | |
| 5,533,697 | 7/1996 | Fletcher et al. | 248/346.03 X |
| 5,671,577 | 9/1997 | Todd | 52/590.1 X |

*Primary Examiner*—Carl D. Friedman
*Assistant Examiner*—Timothy B. Kang
*Attorney, Agent, or Firm*—William W. Stagg

[57] ABSTRACT

A panel for covering building windows comprising a plurality of interlocking tiles interlocked together by a plurality of dovetail joints to form a panel of a desired size. The tiles are constructed of molded plastic. Reinforcing rods, metal or otherwise, may be placed horizontally along the panel and bolted to the window frame to give the panel structure added strength.

10 Claims, 5 Drawing Sheets

STORM WINDOW PANEL

FIELD OF THE INVENTION

The present invention generally relates to the field of window protection for storms and, more particularly, relates to a reusable storm window panel formed from a network of interlocking plastic tiles to cover a window in anticipation of a threatening storm.

BACKGROUND OF THE INVENTION

In areas where storms with dangerously high winds are common, such as the hurricane prone Atlantic and Gulf coast regions of the United States, hundreds of people may be injured and millions of dollars in property damages may be caused due to violent storms. One of the greatest hazards to people and property from such storms is the breakage of glass windows by high winds and flying debris. Hurricane force winds can shatter the windows of households and store fronts sending shards of glass through the air and creating a hazard to both people and property.

Common approaches used to prevent shattered windows include simply nailing sheets of plywood over the windows before a storm arrives or lining the window pane with tape to strengthen pane and control the shattering of glass. These practices are extremely time consuming particularly at a period when a person could be securing important items for storm protection or preparing for an evacuation of the premises. The tedious chore of lining windows or finding plywood, cutting it to fit, and nailing it over every window of a house or building must be repeated before every storm, inevitably several times a hurricane season as it is often inconvenient to store the plywood for reuse.

Efforts have been made to provide removable protective panels for window coverage in violent storms. Such devices are described in U.S. Pat. No. 4,685,261 to Seaquist, No. 4,333,271 to DePaolo, et al, and No. 5,457,921 to Kostrzecha.

The Seaquist patent describes a removable storm shutter that fits in to preinstalled brackets at the top and bottom of the window. The actual window covering segment is one-piece, two panels with a connective bar and side molding, and not easily storable.

The DePaolo patent describes a panel also requires pre-installable brackets but has separable corrugated panels that are vertical and overlapping. That the user slides in place one by one. The panels are removable but more numerous and time consuming to apply. The unsightly brackets on each of these panel designs are time consuming to install and also remain on the window while the panels are not in place leaving an eyesore.

The Kostrzecha patent describes a self contained corrugated panel with a metal support beam. The design requires no brackets but the window covering segment does not break down into smaller pieces and is not easily storable. Also the Kostrzecha apparatus requires a substantial number of screws that must be manipulated to install and remove the panes.

Considering the foregoing, a need exists for a storm window device that can make the routine of protecting windows from hurricane force winds an easier, less time consuming task, with a reusable panel that is easily stored, removed and reinstalled over the windows.

SUMMARY OF THE INVENTION

The interlocking plastic storm window panel of the present invention is designed to satisfy the aforementioned needs. The storm window panel is comprised of a plurality of interlocking tiles made of high strength molded plastic that are secured together by a means of dovetail joints to form a single unit. A plurality of grooves are formed into the face of the front and back surface sheets of each tile to provide a channel or slot along each tile to accommodate metal mounting bars or rods that slide along the back of the completed panel for support and to provide a means to secure the completed unit to a wall or window frame by a plurality of bolts or other attaching means.

Though the window tiles may be formed of solid plastic, in the preferred embodiment each individual window tile is formed of a honeycombed grid of rigid plastic sandwiched between front and back surface sheets. This configuration allows the use of less plastic and at a lighter weight so as to facilitate installation of the window panels. The tiles may have reinforcing ridges formed into the surface sheets. In the preferred embodiment the reinforcing ridges run at 45 degree angles along the front and back surface sheets, the reinforcing ridges on the front surface sheet being perpendicular to the reinforcing ridges on the back surface sheet. This arrangement of reinforcing ridges maximizes the strength of the tiles and allows the use of less material.

The first step in installing the storm window panel is to install the mounting bolts on the window frame. The mounting bolts may be mounted to the window frame or wall surrounding the window by screwing or other conventional means. In the preferred embodiment two bolts are required to secure each metal rod to the wall or window frame and additional bolts may be used at each window corner to secure the corner tiles or each storm window panel.

After the mounting bolts are installed, the storm window panel is then assembled by interlocking the individual tiles so as to form the completed panel. The tile panels may be sequenced or numbered in some distinguishable order so as to facilitate their assembly. The storm window panel is held together by interlocking the male dovetailed joiner of one tile with the female dovetail joiner of its adjacent tile so as to allow the tiles to fit together snugly with each other to form the completed storm window panel.

Individual tiles may vary in size depending upon the size of the window on which they are to be used. The storm window panels may be sized and configured to accommodate a number of standard size windows and openings and may be made up from a plurality of tiles, such as 2 tile-by-2 tile panel or 3 tile-by-3 tile panel and so on depending on the window size.

The tiles forming the edges of the storm window panel are formed with holes to accommodate mounting bolts or screws. In the preferred embodiment the individual tiles are arranged so as to provide mounting holes at the corners of the assembled storm window panel and along its edges as desired.

After the tiles are fitted together the assembled panel is then placed over the window opening with the previously installed mounting bolts penetrating the mounting holes. Nuts or other threaded fasteners are threaded on to the mounting bolts to hold the panel in place over the window. Mounting rods are placed horizontally through the slots along the back and front of the panel. The holes on the ends of the metal rods are lined up and placed over their respective mounting bolts and fastened with nuts. Once the mounting rods are in place the panel is sturdy and ready to withstand high winds. Though in the preferred embodiment the mounting rods are steel or some other metal, the mounting rods can also be made of non-metallic materials.

The storm window panel is easily disassembled by first removing the nuts and then panel from its place on the window frame and pulling apart the individual tiles at their joints. The tiles are relatively small in comparison to the assembled panel and are easily storable. Ornamental and safety coverings may be threaded onto the panel mounting bolts when the storm window panel is not in use.

It is therefore and object of this invention to provide a window protective storm panel to be used with a variety of sizes of windows having a plurality of panels dovetail jointed together and metal rods on either side of the assembled panel for support.

It is another object of this invention to provide a window protective storm panel that is easily disassembled and storable.

It is another object of the invention to provide a storm window panel of molded plastic.

It is still another object of the invention to provide a storm window panel that is reusable and easily storable.

DESCRIPTION OF THE PREFERRED EMBODIMENTS

Figure 1:
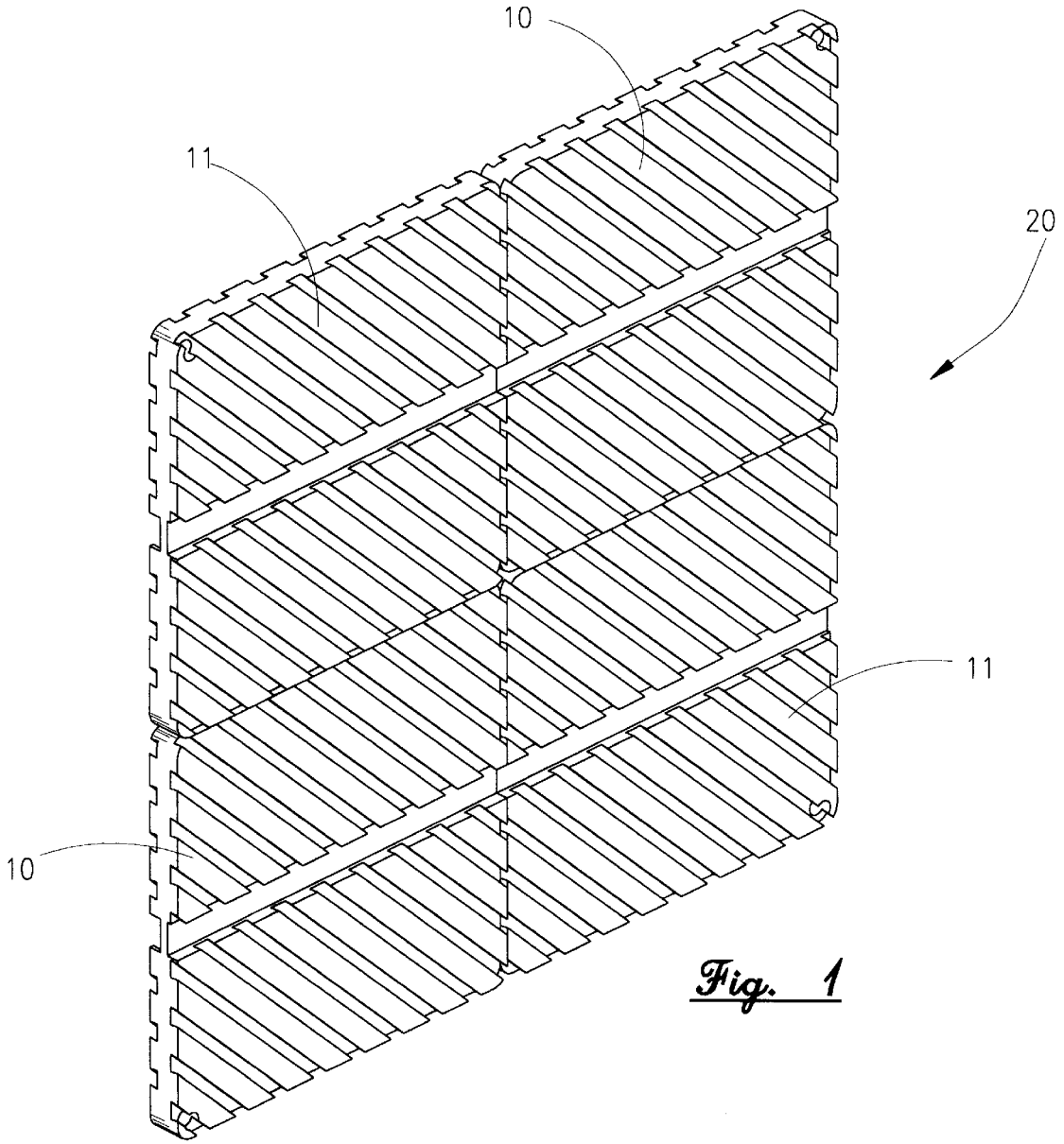
FIG. 1 is a rear view of an assembled storm window panel of the present invention.

Referring now to the drawings, and more particularly to FIG. 1, there is shown a perspective rear view of an assembled storm window panel (20) of the present invention. The panel (20) is comprised of a plurality of individual rectangular tile panels (10,11). In the preferred embodiment it is thought that the tiles (10,11) made of molded plastic with surface dimensions of eighteen inches by twelve inches and having a thickness of approximately one inch will be sufficient though other dimensions and materials may be utilized to form the tiles.

Each tile (10,11) has a front surface (15) and rear surface (17). The front surfaces (15) of the tiles (10, 11) have a plurality of raised diagonal ridges (14). The rear surfaces (17) of the tiles (10, 11) also have a plurality of raised diagonal ridges (14) which are oriented perpendicular to the ridges (14) on front surfaces of tiles (10, 11).

Figure 2:
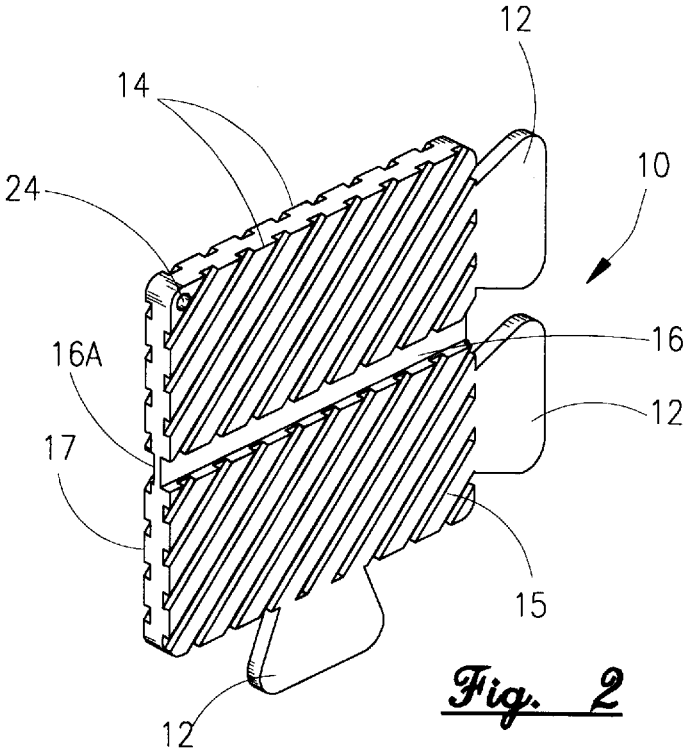
FIG. 2 is a perspective front view of a male dovetailed tile panel of the present invention.
Figure 3:
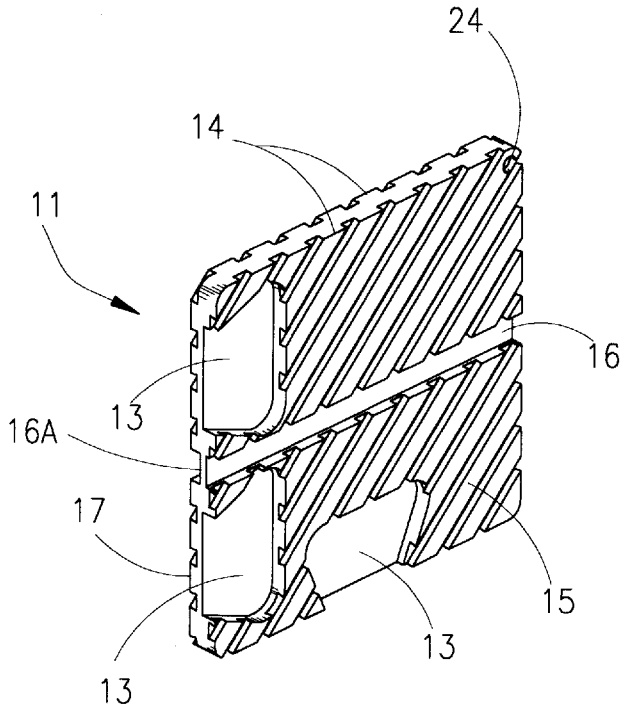
FIG. 3 is a perspective rear view of a female dovetailed tile panel of the present invention.

Individual panel tiles (10, 11) are shown in perspective view in FIGS. 2 and 3, respectively. The tile (10), as shown in FIG. 2, is rectangular in the shape and has a plurality of protruding "male" triangular dovetail joint extensions (12) on its periphery.

The individual panel tile (11) shown in FIG. 3 has a plurality of "female" dovetail joint slots (13) that correspond in shape and location to the protruding "male" joint extensions (12) of tile (10). The joint extensions (12) of "male" tile (10) are shaped and configured to fit snugly together with the joint slots (13) of "female" tile (11).

To form a storm window panel (20) as shown in FIG. 1 a plurality of the individual tiles (10, 11) are fitted by interlocking the protruding "male" joint extensions (12) of a tile (10) and with the corresponding "female" slots (13) of a tile (11). Once assembled, the panel (20) is a single unit comprised of the tiles (10, 11) that is held together by the dovetail connection formed by the protruding joint extensions (12) and the joint slots (13) of tiles (10, 11).

The interlocking tiles (10, 11) may be arranged and configured together in a plurality of predetermined sizes and shapes so as to configure a panel (20) of a desired size and shape to fit a window (30) or other building opening. The tiles (10, 11) may be packaged and sold in numbers to produce a panel (20) to fit a variety of standard size windows. They may also be packaged and sold individually or in multiples so that a user may configure a panel (20) of any desired size as may be required.

For attachment of the panel (20) over a window opening the tiles (10, 11) have holes (24) to receive mounting bolts (22) or other attaching means such as screws. In the preferred embodiment the individual tiles (10,11) are configured and arranged so as 20 to provide mounting holes (24) along the periphery and at the corners of the assembled storm window panel (20).

As shown in FIGS. 1, 2 and 3, each of the tiles (10, 11) has a groove (16) that runs along the length of the front surface (15) and a corresponding groove (16A) that runs along the length of the rear surface (17) of the tiles. In the preferred embodiment the grooves (16, 16A) are each sized to receive a metal bar (18) having a mounting hole (28) at each end, the bars (18) being sized to extend across the width of the completed panel (20). The bars (18) provide further support to the storm window panel (20) after it is assembled and installed over a window.

Figure 4:
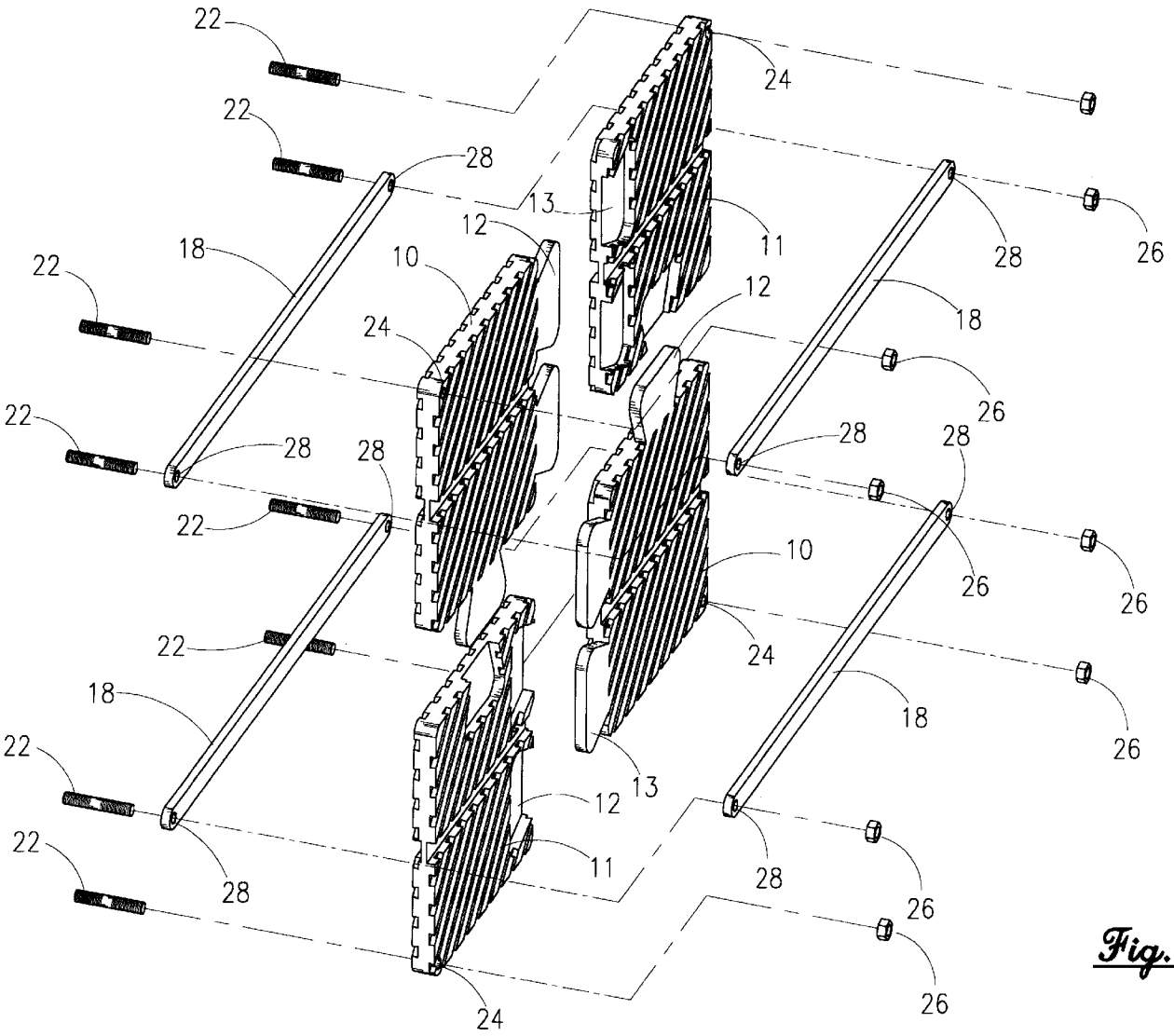
FIG. 4 is an exploded view of a storm window panel with fastening means and metal supporting rods.

FIG. 4 shows an exploded view of the panel (20) with its fasteners and attachments. The tiles (10,11) are shown separated, to illustrate the connective relationship between joint extension (12) and the joint slot (13).

To install the storm window panel (20), threaded mounting bolts (22) must first be mounted onto the window framing (30) or wall (32) by screwing or other means in locations that correspond to the peripheral mounting holes (24) of the tiles (10,11) of the assembled storm window panel (20). The mounting bolts (22) may be positioned around the window opening by placing the assembled panel (20) over the window (30) and marking the appropriate bolt locations on the wall (32). The panel is installed and supported over the window opening by inserting the prepositioned mounting bolts (22) though the mounting holes (24) of the panel (20) and fixing the panel (20) in place with threaded nuts (26) or other threaded fasteners.

Once the panel (20) is installed over the window (30) the metal support bars (18) are then placed in sets of two, with one bar (18) in the groove (16) on the front and one bar (18) in the groove (16A) on the back of the panel (20) so that the bars (18) extend across each tile (10,11) of the panel (20) for the entire width of the window opening. In the preferred embodiment the number of pairs of metal bars (18) required for a particular panel (20) is that equal to the number of rows of tiles (10,11) necessary to make up the vertical component of the panel's dimensions. The bars (18) provide added support for the panel (20) and increase its stability under high force winds. The metal bars (18) are secured to the wall or frame around the window (30) by additional bolts (22) or other fasteners.

Figure 6:
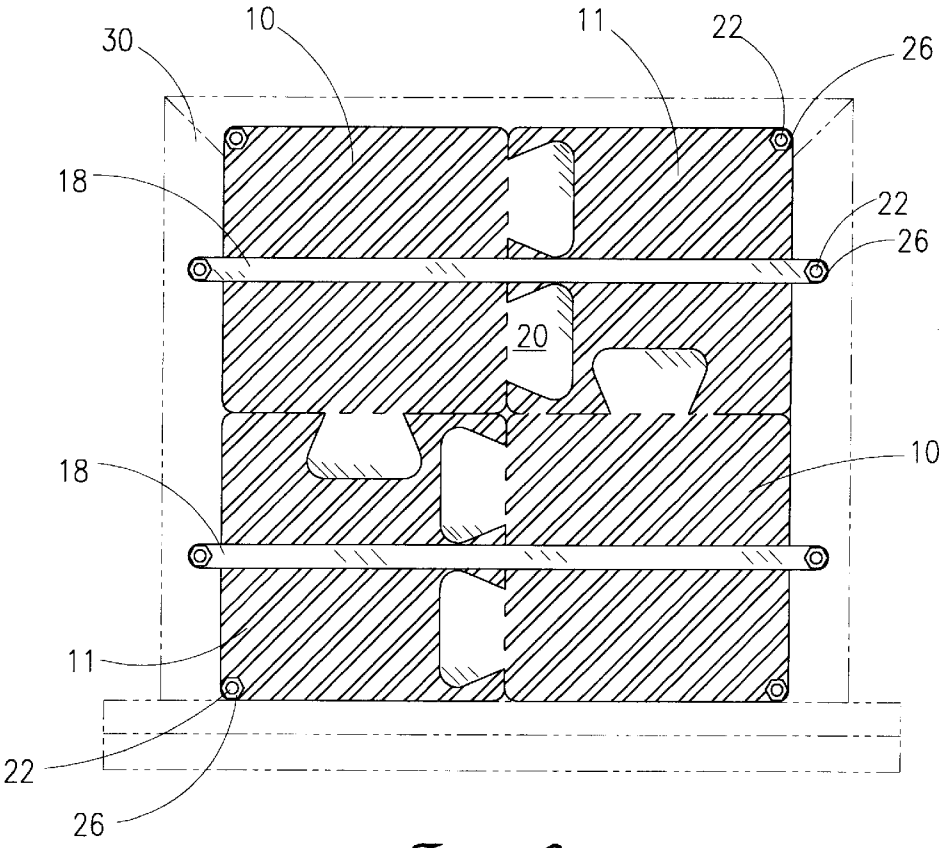
FIG. 6 is a frontal view of an assembled storm window panel installed over a window.
Figure 5:
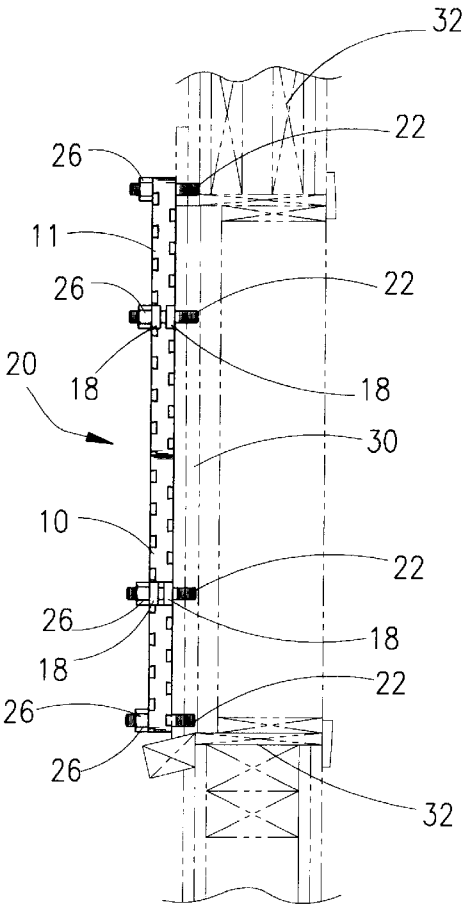
FIG. 5 is a side view of an assembled storm window panel installed over a window.

FIG. 5 shows a side view of the assembled panel (20) with its relationship to the window glass visible. The dotted lines represent a portion of the wall (32) which has been omitted. A storm panel (20) installed over a window (30) is shown in FIG. 6.

Figure 7:
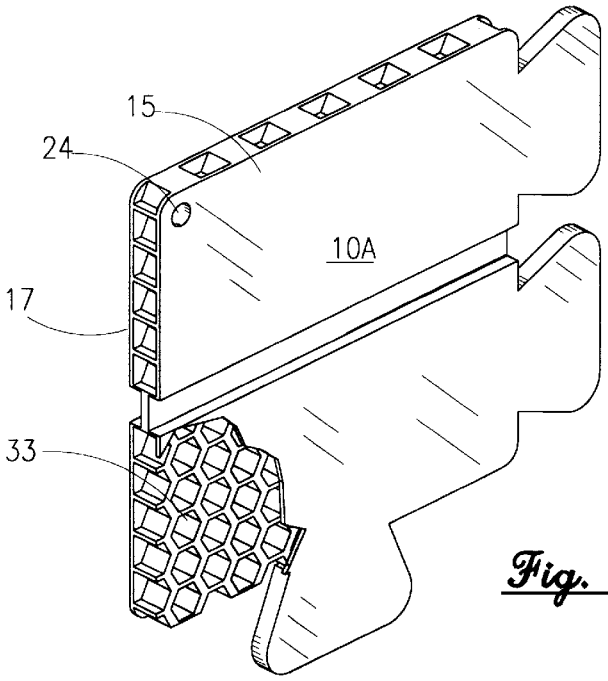
FIG. 7 is a cut-a-way view of a panel tile of the storm window panel of FIG. 1.

FIG. 7 is a cut-a-way view of an alternate embodiment of "male" a panel tile (10) of the present invention designated (10A). The front surface (15) of tile (1OA) is cut-a-way to show a honeycomb-like reinforcing grid (33) sandwiched between the tile front surface (15) and the tile rear surface (17). The "female" panel tile (11) may be constructed in a similar manner.

Figure 8:
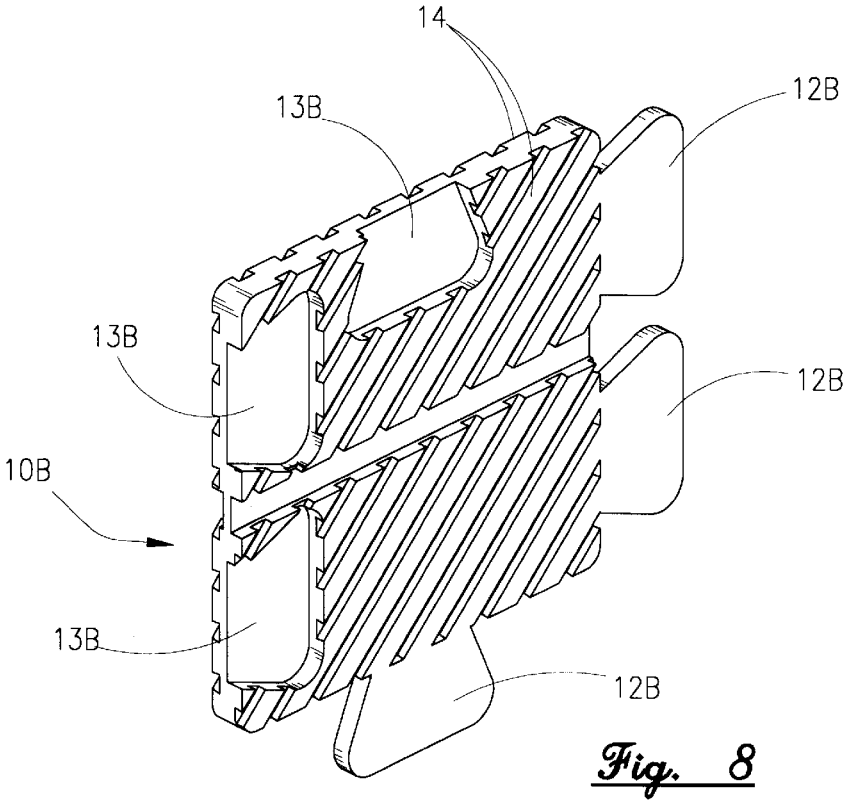
FIG. 8 is a perspective view of an alternative embodiment of a tile panel of the present invention.

FIG. 8 is a perspective view of an alternative embodiment of a panel tile of the storm window panel (20) designed (10B). The tile panel (10B) has protruding "male" extensions (12B) and "female" dovetail joint slot (13B) that corresponds in shape and size to extension (12B). A panel (20) can be formed by interlocking multiple tiles (10B) together.

It is thought that the storm window panel and method of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. A storm window panel for protecting a window during storms comprising:

(a) a plurality of individual interlocking tiles;

(b) a plurality of dovetail joint assemblies formed into said tiles for temporarily interlocking said tiles with each other so as to form a panel, each of said dovetail joint assemblies having a protruding male joint extension and a female joint slot corresponding in size and shape to said male joint extension;

(c) a reinforcement channel formed on each of said individual tiles, said channels adapted so that when said individual tiles are interlocked together each said reinforcement channel of adjoining individual tiles thereby form a plurality of reinforcement channels extending across said panel;

(d) a plurality of reinforcing bars engaging said reinforcing channels, said bars having a length sufficient to extend across said panel; and (e) means for mounting said panel over a window.

2. A panel as recited in claim 1, wherein said reinforcing bars are made of non-metallic materials.

3. A panel for covering building windows comprising:

(a) a plurality of male tiles, said male tiles having a plurality of protruding fan-shaped joint extensions and front and rear surfaces;

(b) a plurality of female tiles, said female tiles having front and rear surfaces and a plurality of fan-shaped slots corresponding in size and shape to said joint extensions of said male tiles whereby by said male tiles may be interlocked with said female tiles to form a panel of a desired size;

(c) each of said male and female tiles further comprising a plurality of raised ridges running diagonally across said front and rear surfaces thereof; and (d) a means for mounting said panel to a window frame over said windows.

4. A panel as recited in claim 3, further comprising a plurality of reinforcing bars fitted into said reinforcement channels, said reinforcing bars extending across said panel.

5. A panel as recited in claim 4, wherein said reinforcing bars are adapted to be fixedly attached to said window frame.

6. A panel as recited in claim 5, wherein said panel has a plurality of mounting holes around a periphery thereof, said mounting holes configured to receive a plurality of mounting bolts to thereby mounted panel to the periphery of said window frame.

7. A panel as recited in claim 6 wherein said male and female tiles are formed from plastic.

8. A panel as recited in claim 6, wherein said male and female tiles are comprised of a rigid honeycombed grid sandwiched between said front and rear surfaces.

9. A panel as recited in claim 8, wherein said tires are made of molded plastic.

10. A panel as recited in claim 9, wherein said reinforcing bars are metal.

* * * * *